United States Patent [19]

Fox

[11] 4,282,707

[45] Aug. 11, 1981

[54] CHAIN BREAKING TOOL

[76] Inventor: Robert O. Fox, R.D. #7, Box 258, New Castle, Pa. 16102

[21] Appl. No.: 85,901

[22] Filed: Oct. 18, 1979

[51] Int. Cl.[3] ..... B21L 21/00

[52] U.S. Cl. ..... 59/7; 29/283; 59/11

[58] Field of Search ..... 59/7, 11; 29/283; 269/154, 246, 248, 249

[56] References Cited

U.S. PATENT DOCUMENTS

| | | | |
|---|---|---|---|
| 2,691,267 | 10/1954 | Baber | 59/7 |
| 3,212,253 | 10/1965 | Granberg | 59/7 |
| 3,464,201 | 9/1969 | Ehlen | 59/7 |
| 3,606,663 | 9/1971 | Ahart, Sr. | 29/283 |
| 3,668,767 | 6/1972 | Bebo | 29/283 |
| 4,030,286 | 6/1977 | Gibilaro | 59/7 |
| 4,084,369 | 4/1978 | Luebbers | 59/7 |
| 4,221,113 | 9/1980 | Jordan | 59/7 |

*Primary Examiner*—John McQuade

*Attorney, Agent, or Firm*—Harpman & Harpman

[57] ABSTRACT

A tool for removal and reassembly of selective links of a chain includes separate clamping means for holding different types of chains and provides a tapered link engaging surface against which a selected link to be removed can be driven to separate the same from the chain. Indicators are also provided to enable a chain having removable pins to be aligned for the easy removal of the pins and the separation or reassembly of the links thereof.

6 Claims, 3 Drawing Figures

CHAIN BREAKING TOOL

BACKGROUND OF THE INVENTION (1) Field of the Invention

This invention relates to drive chain repair tools and more particularly to tools which facilitate the removal and replacement of links of a sprocket chain or the like. Such sprocket chains are formed of a plurality of releasable connected links and have been utilized in a wide variety of mechanical applications including farm machinery. Links of such chains include a generally rectangular open framework having a pintle or male connecting part extending along one end thereof and a sleeve or female connecting part extending along the opposite edge. The pintle of one link is slid transversely to the longitudinal axis of the chain into the sleeve of the adjacent chain link through a slot in the sleeve approximately the same width as the thickness of the chain link. When the chain is then put in use, the hinge connection remains together and is difficult to separate. When it becomes necessary to replace one or more links because of damage, a tool such as disclosed herein can be quickly and easily applied to the chain, properly supported and the links removed in a combination driving and wedging action.

(2) Description of the Prior Art

Prior tools as known in the art are best represented by U.S. Pat. No. 4,084,369 wherein a vice engages the upper and lower surfaces of the chain when the same is in a vertical plane and requires the use of a chisel-like tool and hammer to effect separation and/or replacement of a link. A typical pin removing tool may be seen in U.S. Pat. No. 4,030,286.

The present invention provides a tool which may be used to remove the selected links of a sprocket chain as well as remove the pins from a pin assembled chain.

In U.S. Pat. No. 4,084,369, downward force is necessary to separate the selective links of the sprocket chain.

In the present invention, downward driving force moves the selected link against a tapered surface which effects a rapid separation of the link from the adjacent link and facilitates quick and easy removal. Another portion of applicant's tool provides location indicators to permit a pin assembled link chain to be positioned with respect to a plurality of openings with which the pins will register so as to facilitate the rapid and easy removal of the pins from the chain and the separation thereof.

SUMMARY OF THE INVENTION

A chain breaking tool comprises a device having an associated pair of clamps for engaging open center sprocket chains and dual link pin assembled chains and the like. The portion of the tool receiving and holding the open center sprocket chains provides a beveled arcuate surface against which a portion of a link to be removed is engaged to facilitate and expedite removal.

DESCRIPTION OF THE PREFERRED EMBODIMENT

Figure 1:
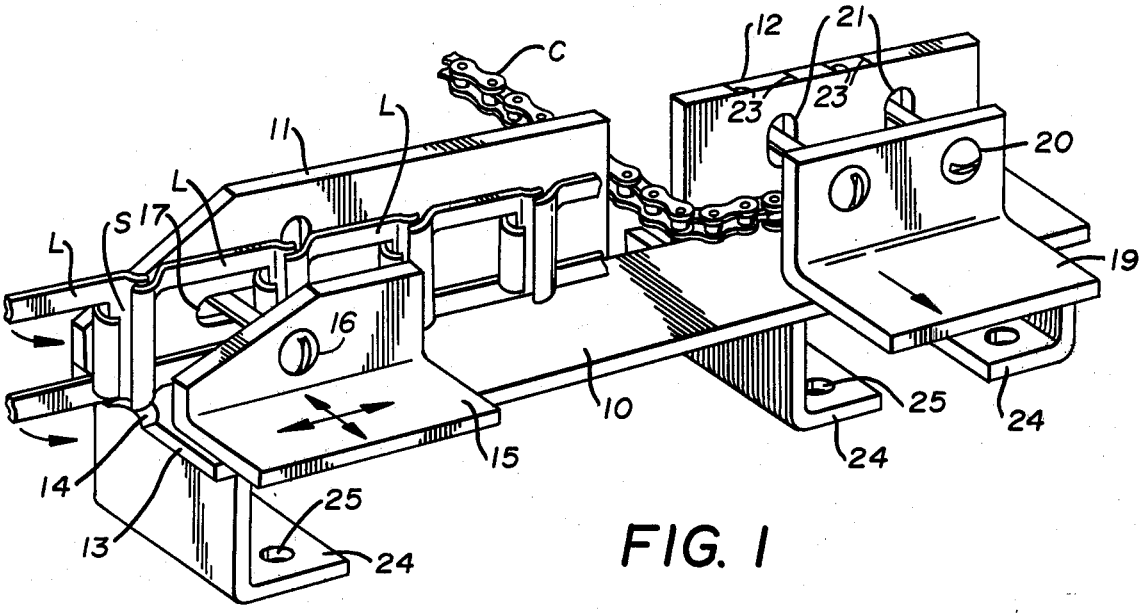
FIG. 1 is a perspective elevation of the chain breaking tool with portions of a pair of typical chains positioned therein.

By referring to the drawings and FIG. 1 in particular it will be seen that the chain breaking tool comprises an elongated body member 10 having a pair of vertically standing side sections 11 and 12 respectively positioned in longitudinally spaced relation on one edge thereof. An end 13 of the elongated body member 10 is provided with an offset tapered arcuate area 14 against which a portion of a link L in a sprocket chain formed of several such links may be positioned so as to be driven sidewardly upon engaging the area 14. In order that the sprocket chain formed of the several links L can be held in proper position for such separation of one of the links, a cross sectionally L-shaped clamp 15 is movably positioned on the elongated body member 10. A bolt 16 is positioned through the vertical portion of the cross sectionally L-shaped clamp 15 and extends though one of the open centers of one of the sprocket links L and through a slot 17 in the vertical standing side section 11. The chain formed of the several links L may thus be held firmly in vertical position as shown in FIG. 1 of the drawings, and with the inner end of the link L to be removed positioned above the offset tapered arcuate area 14 in the end 13 of the elongated body member 10. In order to remove the link L, the one to the extreme left as seen in FIG. 1 of the drawings, it is moved as indicated by the arrows until the upper and lower horizontal portions align with a slot S defined by the left end configuration of the adjacent link L whereupon downward movement imparted the link L to be removed as by a hammer or other tool will engage the lower inner corner of the link L to be removed against the offset tapered arcuate area 14 and force it by wedging action outwardly through the slot S of the adjacent link end configuration to effect a quick and easy separation.

To reassemble the chain by replacing a link L or adding a link L thereto, the cross sectionally L-shaped clamp 15 is adjusted to permit the several links of the chain to be positioned inwardly of the position illustrated in FIG. 1 of the drawings so that the link to be added can be turned to bring the upper and lower horizontal sections thereof into alignment with the slot S and the link driven downwardly into proper position in a snap in like action.

The device of the invention therefore provides means for effectively removing a link from an open center sprocket chain as well as replacing a link or adding a link thereto.

By referring now to the right end of the device shown in FIG. 1 of the drawings, it will be seen that a secondary cross sectionally L-shaped clamp 19 is shown positioned for transverse movement on the elongated body member 10 and a pair of bolts 20 are shown positioned through openings therein and extending through matching openings 21 in the vertically standing side section 12. A dual link pin assembled chain C is shown positioned on its side with the pins arranged in vertical relation where they join the rollers of the chain and the longitudinal side portions as will be understood by those skilled in the art.

By referring now to FIG. 3 of the drawings, it will be seen that the elongated body member 10 has a plurality of openings 22 therein directly below the location of the chain C when positioned thereon and that a plurality of indicator marks 23 are formed on the upper edge of the vertically standing side section 12 so that when the chain C is positioned on the body member 10 with the pins in registry with the openings 22 and held in such position by tightening the bolts 20 to bring the secondary clamp 19 into operation, a drift pin, not shown, can be quickly and easily positioned on the pins holding the chain C in assembly and aligned with the indicator marks 23 and upon being struck from above will move the pins downwardly through the openings 22 to separate the chain.

Assembling such a pin and roller link chain is expedited by positioning the chain so that the pins will not register with the openings 22 whereupon the pins and the drift pin tool can be used to replace the pins quickly and easily.

Figure 2:
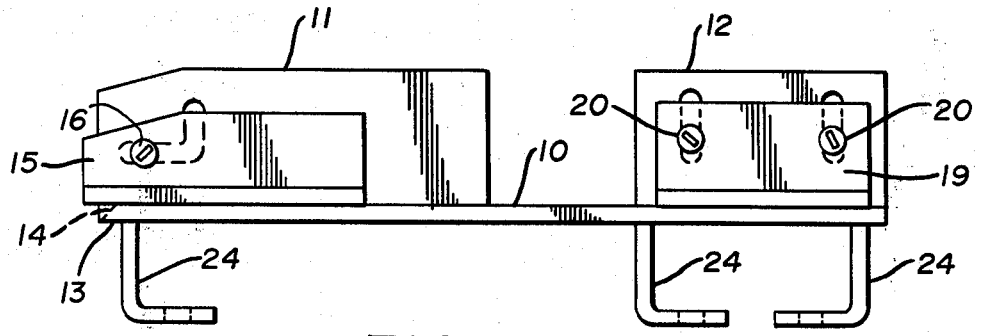
FIG. 2 is a side elevational view of the chain breaking tool.

By referring now to FIGS. 1 and 2 of the drawings, it will be seen that the elongated body member 10 is supported by a plurality of L-shaped brackets 24 which may be apertured as at 25 so that the tool can be mounted on a supporting base if desired.

Figure 3:
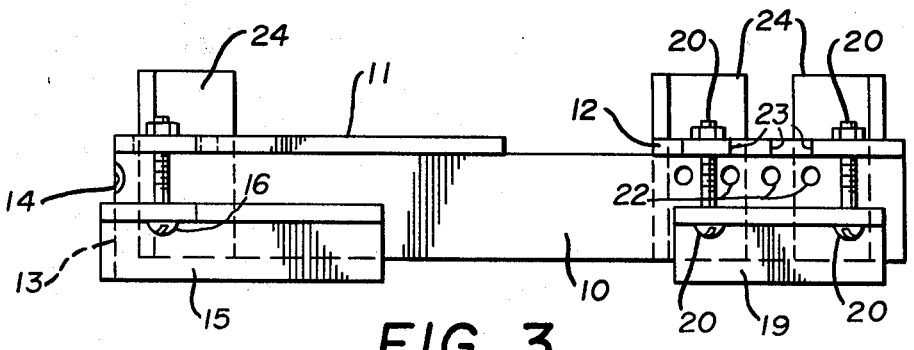
FIG. 3 is a top plan view of the chain breaking tool.

By referring to FIG. 3 of the drawings it will be seen that each of the L-shaped support brackets 24 is preferably of a length greater than the width of the elongated body member 10 and its vertically standing side sections 11 and 12.

It will thus be seen that a simple and relatively inexpensive easy to use chain breaking tool has been disclosed which may be used to quickly and easily separate the links of various types of chains and which may also be used to facilitate the reassembly of such links into a chain.

Although but one embodiment of the present invention has been illustrated and described, it will be apparent to those skilled in the art that various changes and modifications may be made therein without departing from the spirit of the invention and having thus described my invention what I claim is:

1. A chain breaking tool for use with detachable sprocket chains of the type with links which include a generally rectangular shaped frame with a male end or pintle and an open sided female end or sleeve at the other end, the pintle of one link being received in the sleeve of an adjoining link to connect the two, said tool comprising an elongated body member having at least one cross sectionally L-shaped clamp slidably positioned thereon for longitudinal and transverse movement, at least one vertically standing side section on said elongated body member adjacent said clamp and means for moving said clamp toward said side section to effect a clamping action on a chain positioned on its edge with its links disposed vertically therebetween, an offset tapered arcuate area formed in one end of said elongated body member and disposed between said clamp and said side section and beneath engaged ends of two links in said chain whereby downward movement imparted one of said two links brings the same into engagement with said offset tapered arcuate area to impart sideward motion to said link and facilitate its separation from the other of said two links.

2. The chain breaking tool set forth in claim 1 and wherein a plurality of longitudinally spaced openings are formed in said elongated body member and a plurality of matching indicating marks are formed on one of said vertically standing side sections and in substantial vertical registry with said openings whereby a chain incorporating links, rollers and pins may be engaged and clamped with said pins in registry with said openings as indicated by said indicating marks.

3. The chain breaking tool set forth in claim 1 and wherein said cross sectionally L-shaped clamp is movable to a position extending beyond said end of said elongated body member in which said offset tapered arcuate area is formed whereby the open sided female end or sleeve of one of said links may be clampingly engaged thereby.

4. The chain breaking tool set forth in claim 1 and wherein support members are positioned beneath said elongated body member and spaced inwardly from said end thereof in which said offset tapered arcuate area is formed.

5. The chain breaking tool set forth in claim 1 and wherein said cross sectionally L-shaped clamp and said vertically standing side section are apertured and said means for moving said clamp toward said side section comprises a bolt.

6. The chain breaking tool set forth in claim 1 and wherein portions of said cross sectionally L-shaped clamp and said vertically standing side section adjacent the end of the elongated body member in which the offset tapered arcuate area is formed are of a height less than the links of the chain disposed therebetween.

* * * * *